United States Patent [19]

Davies

[11] Patent Number: 4,750,688

[45] Date of Patent: Jun. 14, 1988

[54] LINE OF SIGHT MISSILE GUIDANCE

[75] Inventor: David R. Davies, Stevenage, United Kingdom

[73] Assignee: British Aerospace PLC, London, United Kingdom

[21] Appl. No.: 925,257

[22] Filed: Oct. 31, 1986

[30] Foreign Application Priority Data

Oct. 31, 1985 [GB] United Kingdom ..... 8526851

[51] Int. Cl.[4] ..... F41G 7/20

[52] U.S. Cl. ..... 244/3.11; 244/3.15

[58] Field of Search ..... 244/3.11, 3.15

[56] References Cited

U.S. PATENT DOCUMENTS

| | | | |
|---|---|---|---|
| 4,465,249 | 8/1984 | Selince | 244/3.15 |
| 4,492,352 | 1/1985 | Yueh | 244/3.15 |
| 4,529,151 | 7/1985 | Skarman | 244/3.15 |
| 4,541,591 | 9/1985 | Chadwick et al. | 244/3.15 |

*Primary Examiner*—Charles T. Jordan

*Attorney, Agent, or Firm*—Cushman, Darby & Cushman

[57] ABSTRACT

In known guidance systems, the missile is guided by a control loop which includes the missile and a ground-based tracker, the tracker determining the relative positions of the missile and target and hence the lateral acceleration to be applied to the missile. However, these systems do not take account of the lateral acceleration generated by the coupling of the missile acceleration along its longitudinal axis and the angle between the body of the missile and the sightline, as in cases where acceleration is small the effect is insignificant. Described herein is a system for modifying the demand component to effect compensation for the lateral acceleration component imparted to the missile by virtue of its angle of incidence. This is accomplished by modifying the demand component in accordance with a stored predetermined time-varying gain term thereby to effect compensation of the lateral acceleration component imparted to the missile by virtue of the angle of incidence of the missile.

9 Claims, 3 Drawing Sheets

LINE OF SIGHT MISSILE GUIDANCE

This invention relates to line-of-sight missile guidance systems and in particular, but not exclusively, to such systems for guiding missiles phase when the missile is accelerating, either during a motor boost phase or due to aerodynamic drag alone.

In known systems, the missile may be guided by a semi-automatic-command-to-line-of-sight (SACLOS) system or an automatic-command-to-line-of-sight (ACLOS) system or by a beam riding guidance system. Guidance is achieved by means of an outer control loop including the missile and a ground-based tracker. In ACLOS and SACLOS systems the ground based tracker determines the relative positions of the missile and the target and determines the appropriate lateral acceleration (latax) to be applied to the missile and transmits these to the missile control system by a command link. In beam riding systems that is carried out in the missile which detects its position relative to a reference beam collimated with the target tracker.

In these conventional systems, in calculating the latax to be applied, no account is taken of the component of latax generated by coupling of the missile acceleration along its longitudinal axis (longax) and the angle between the body of the missile and the sightline. In cases where the missile is not or is no longer accelerating, or the acceleration is small, this is not of significance, but where the missile is undergoing a large degree of forward acceleration either positive or negative the effect can cause problems. In addition, feed forward acceleration required by the missile to compensate for the Coreolis acceleration produced by a rotating sightline includes a term which compensates for missile longitudinal acceleration; again this term is usually ignored in conventional systems.

SUMMARY OF THE INVENTION

According to one aspect of this inventin, there is provided a missile guidance system including means for determining a demand component of lateral acceleration to be applied to a missile, and means for modifying said demand component in accordance with a stored predetermined time-varying gain term thereby to effect compensation of the lateral acceleration component imparted to the missile by virtue of the angle of incidence of the missile.

DETAILED DESCRIPTION OF THE PREFERRED EMBODIMENT

The system to be described incorporates a command to line of sight guidance loop specially adapted to compensate for the angle of incidence of the missile and thus to minimise or obviate longax coupling gain.

Figure 1:
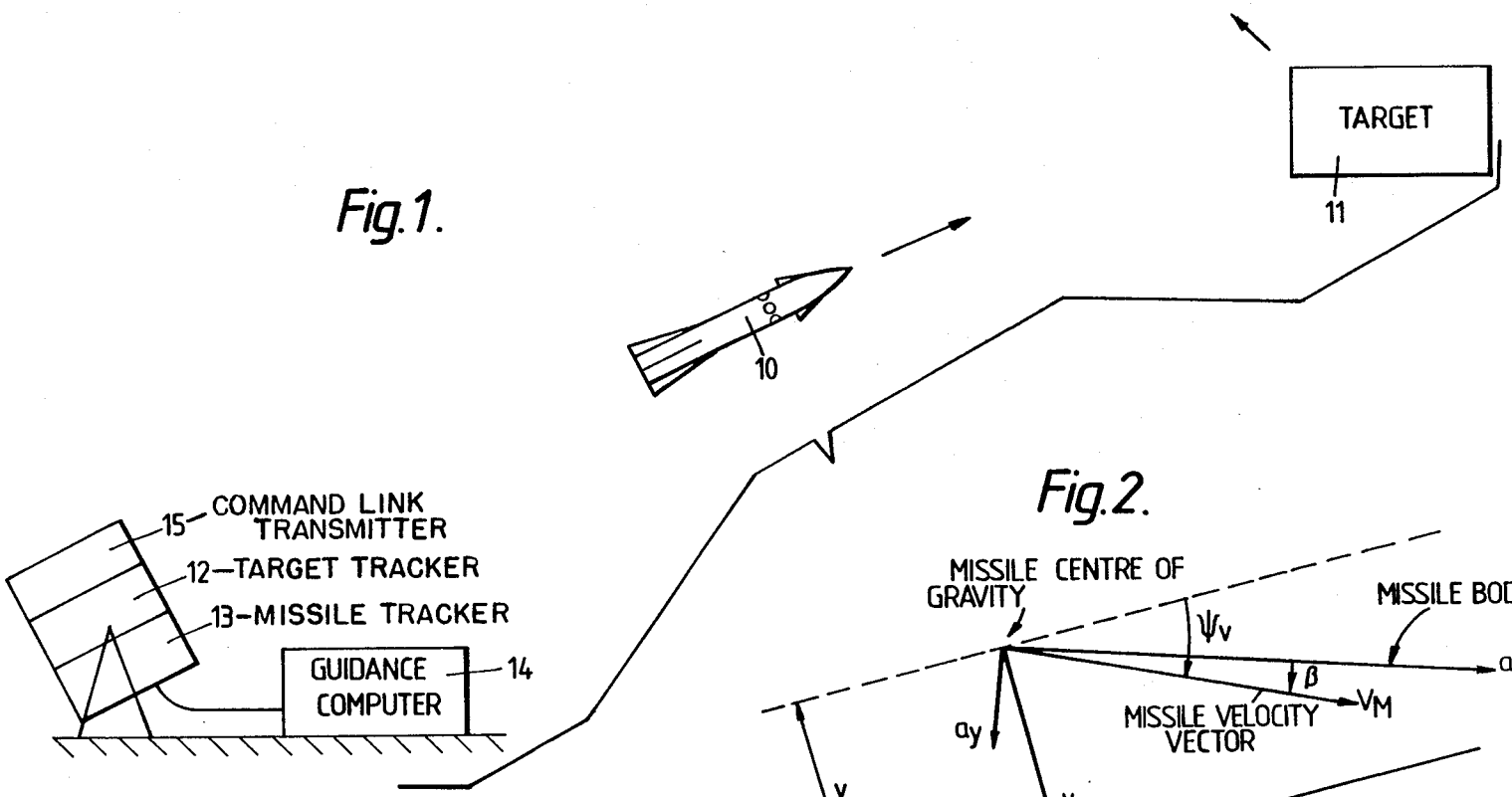
FIG. 1 is a schematic block diagram illustrating the components of a first form of guided missile system.

Referring initially to FIG. 1, the missile system includes a self-propelled missile 10 incorporating a boost motor and a system for flight control; a target 11; a target tracker 12; a missile tracker 13 which tracks a pyrotechnic flare on the missile; a guidance computer 14; and a command link transmitter 15. The missile 10 has natural stability without an autopilot and guidance is achieved by closing an outer guidance loop through the ground equipment. The missile includes a roll gyroscope/resolver to resolve space-referenced guidance commands to the rolling missile body axes. Injected into the guidance loop at the ground equipment are the target position data, which are input either manually by the operator or automatically by the target autotracker 12, depending on whether guidance is SACLOS or ACLOS. The trackers 12 and 13 and the command link transmitter are supported during engagements by an active stable platform which is maintained on the target line of sight by the combined action of either manual or automatic tracking together with a gyroscope and torque motors acting on gimbals.

The guidance employed in the system of FIG. 1 will now be described with reference to FIG. 2. Once a target has been sighted and is tracked and the launcher is pointing towards the target the missile may be launched. The guidance loop is triggered on reception of signals from the target and the missile trackers indicating that both the missile image and the target image have been successfully tracked, however command signals generated by the loop are not implemented until after a predetermined time delay. This time delay is governed by the arithmetic value achieved by the ratio $$\frac{\text{MISSILE LONGITUDINAL ACCELERATION (LONGAX)}}{\text{MISSILE VELOCITY}}$$

This ratio is required to have a value of, typically, two or less for a stable guidance loop to be realised. This is one feature of the invention.

Following launch of the missile the guidance loop is triggered on reception from a signal from the tracker indicating that the missile image is being successfully tracked.

Figure 3:
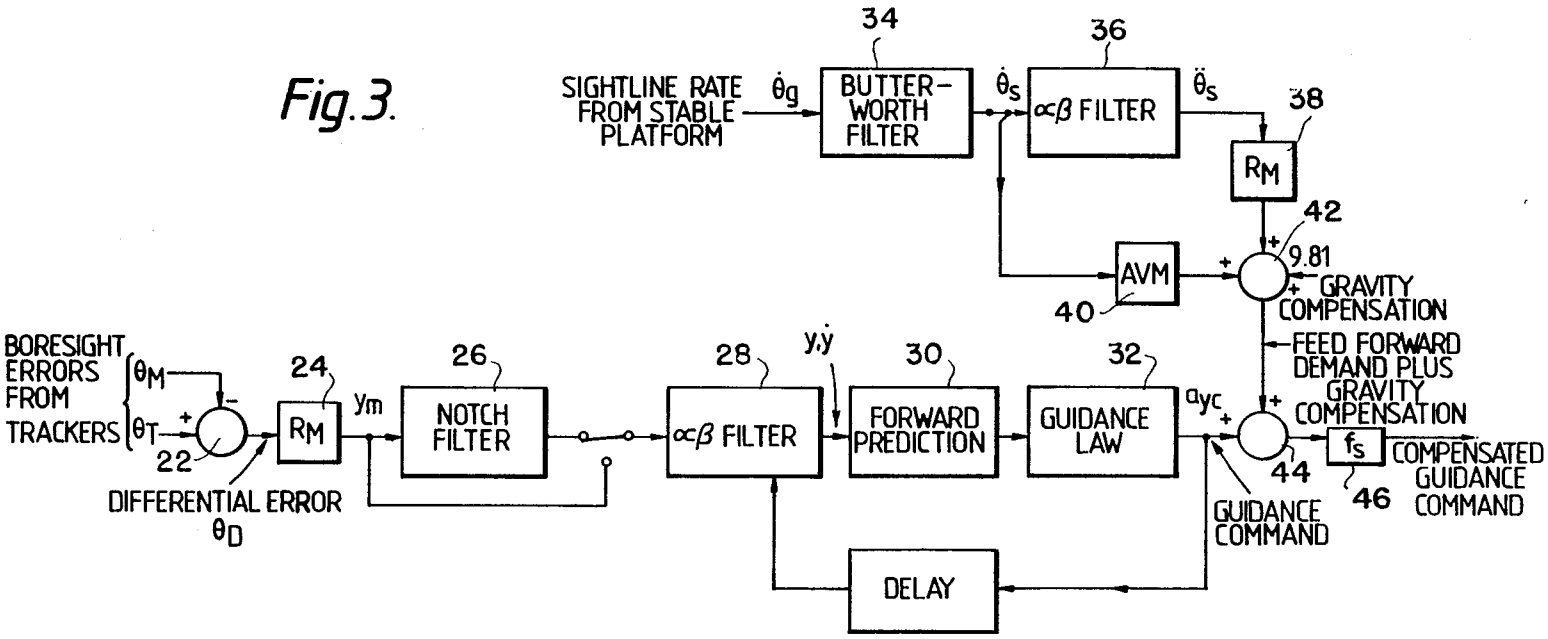
FIG. 3 is a schematic representation of the guidance algorithm incorporated in the system of FIG. 1.
Figure 4:
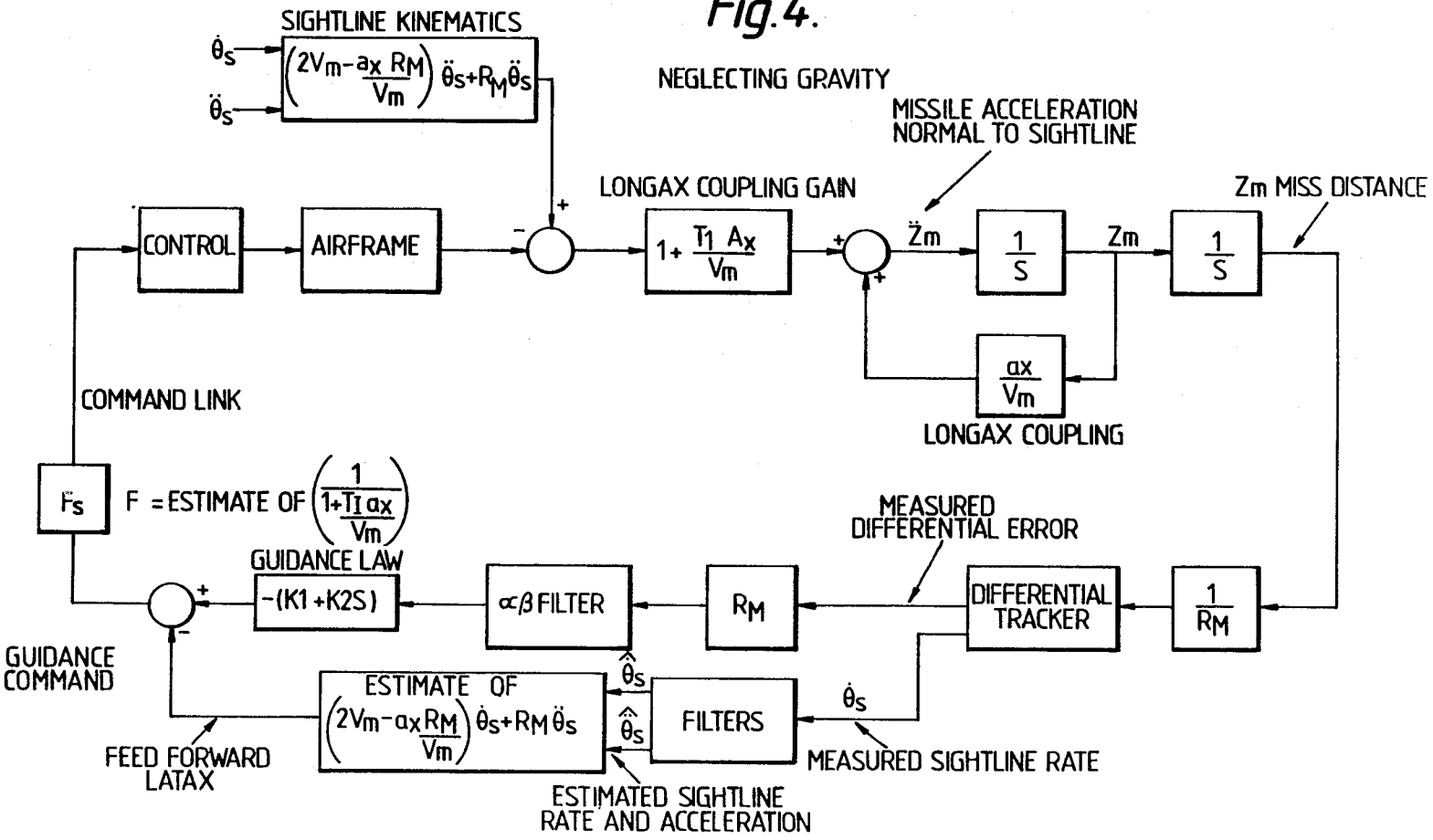
FIG. 4 is a schematic representation of the guidance loop.

During flight of the missile, the boresight errors from the target and missile trackers $\theta_T$ and $\theta_M$ are measured and subtracted by operator 22 to determine the missile to target differential error $\theta_D$(See FIG. 3). The missile range $R_M$ is determined from a look up table 24 associated with the guidance computer relating missile time of flight with estimated missile range and multiplied by the differential error $\theta_D$ to produce measurements of the components of projected missile miss distance in orthogonal reference planes. Each component is processed to determine an elevation latax command and an azimuth latax demand which are subsequently combined and then processed to compensate for longax coupling prior to transmission to the missile for implementation. Prior to combination each component is processed in the same manner and thus, for ease of description the processing of only one component, the y component will be described in detail. The measured miss distance $y_m$ is prefiltered with a notch filter 26 centred on the estimated value of the missile airframe natural frequency to remove the airframe weathercock oscillation due to the lightly damped response of the missile airframe. The filter is however bypassed during the initial and final stages of missile travel.

Estimates of the miss distance y and miss distance rate y are derived using an alpha-beta filter 28 applied to the measured miss distance and a forward prediction of miss distance is calculated in operator 30 to overcome some of the effects of time delays in the system. The latax demand $a_{yc}$ to reduce miss distance is then calculated in operator 32 using a proportional plus differential guidance law of the form $$a_{yc} = -(K_1 y + K_2 \dot{y}).$$

The feed-forward latax demand is calculated based upon the filtered target sightline rate $\theta_s$ (from Butterworth filter 34) and acceleration $\theta_s$ (from filter 36) and the latax demand due to feed forward is combined ith the gravity compensation demand required in the elevation plane (operators 38, 40, 42), and then combined with that of the guidance law at operator 46. Guidance commands are then multiplied in operator 46 by a scaling gain $F_s$ which is a predetermined function of flight time and performs the necessary compensation for longax coupling. The scaling gain is therefore applied to the closed guidance loop latax demand, the feed forward latax demand and the gravity compensation demand.

Figure 2:
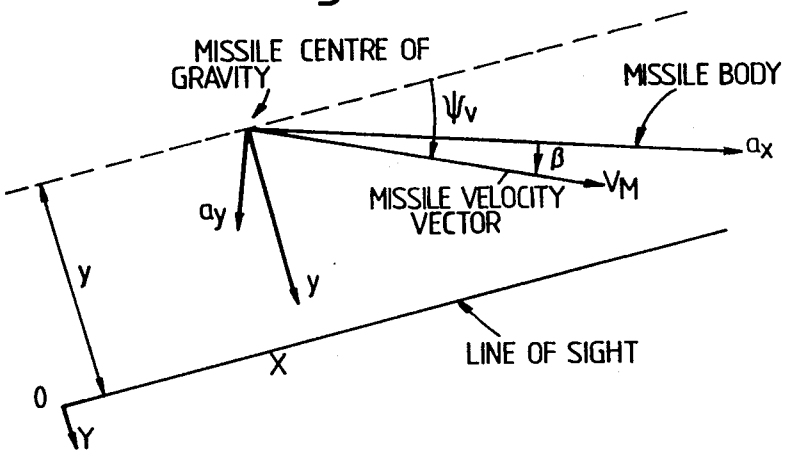
FIG. 2 is a diagram illustrating the various axes associated with the missile.

Referring to FIG. 2, the various areas associated with the missile and to be referred to below will now be described.

The tracker 12/13 is located at the origin O of an orthogonal set of axes OX and XY, OX being the line of sight to a particular target. The missile 10 is located with its centre of gravity spaced from the line of sight OX by a distance y, known as the miss distance. The missile has a longitudinal acceleration (longax) $a_x$ and a lateral acceleration (latax) $a_y$, a velocity $V_m$ at an angle $\Psi_v$ to the sightline OX and an angle of incidence $\beta$. The angle between the missile body and the sightline is therefore $\sigma_m = \Psi_v - \beta$.

Consequently the acceleration of the missile normal to the sightline is:

$$\dot{y} = a_x \sin \sigma_m + a_y \cos \sigma_m$$

the solution of which would apparently require the missile body angle relative to the line of sight—$\sigma_m$—to be measured.

However, the expression $a_x \sin \sigma_m$ may be approximated to $a_x (\ddot{y}/V_m + a_y T_I/V_m$ where $T_I$ is the airframe incidence lag time constant, and the above expression for y may be written as $$\ddot{y} = (\text{Cos } \sigma_m + a_x T_I/V_m) a_y + a_x/V_m y$$

This results in a feedback element from missile velocity to missile acceleration of magnitude $a_x/V_m$ relative to the sightline. Shortly after missile launch, when the missile is under boost acceleration, the value of $a_x/V_m$ is large and introduces an unstable pole into the kinematics of the guidance loop making a conventional guidance loop unstable. To accommodate this, closed loop missile guidance is delayed until stable guidance is assured. This is when the value of $a_x/V_m$ is less than about 2. In addition, coupling of longitudinal acceleration gives an increase in guidance loop gain under boost acceleration, the additional gain having a value $$G = \left(1 + \frac{T_I \cdot a_x}{V_m}\right)$$

and it is in this gain, due to longax coupling, which is compensated in the scaling gain $F_s$.

$F_s$ is time dependent and stored in a look up table to be interrogated to effect appropriate modification of the total latax demand to allow for dynamic compensation of missile longax coupling in a line of sight guidance law.

The technique enables missile longax coupling to be compensated without a requirement to measure the missile body angle relative to the line of sight.

The scaling gain $F_s$ for the missile is determined by computer simulation as a function of time and is stored in a look up table for implementation in the guidance loop.

I claim:

1. In a missile guidance system for guiding a missile toward a target, said missile guidance system having a missile tracker and a target tracker and applying a lateral acceleration to said missile, apparatus for compensating for acceleration of said missile, comprising:

means for determining a demand component of the lateral acceleration applied to said missile; and means for modifying said demand component with a predetermined, time-varying gain factor in order to compensate for said missile acceleration.

2. Apparatus according to claim 1, further including means for providing compensated guidance commands to said missile, said compensated guidance commands corresponding to said modified demand component.

3. Apparatus according to claim 2, further including means for delaying said compensated guidance commands by a predetermined time delay.

4. Apparatus according to claim 3, wherein said time delay means includes means for delaying said guidance commands until a ratio of missile longitudinal acceleration to missile velocity exceeds a predetermined value.

5. Apparatus according to claim 1, wherein said determining means includes:

means for receiving bore sight errors from said target tracker and said missile tracker;

means for measuring and subtracting said bore sight errors to provide a missile-to-target differential error;

means, coupled to said measuring and subtracting means, for determining missile range, and for calculating a missile miss distance;

notch filter means for receiving and filtering said miss distance;

alpha-beta filter means, coupled to said notch filter means, for providing a derived miss distance and a derived miss distance rate;

forward prediction means, coupled to said alpha-beta filter means, for providing a forward prediction of miss distance;

guidance law means, coupled to said forward prediction means, for calculating said demand component of said lateral acceleration;

means, coupled to said target tracker, for calculating a feed forward demand for said missile;

means for applying a gravity compensation for said feed forward demand;

means for combining said gravity compensated feed forward demand with said calculated demand component of lateral acceleration.

6. In a missile guidance system for guiding a missile toward a target, said missile guidance system having a missile tracker and a target tracker and applying a lateral acceleration to said missile, a method for compensating for acceleration of said missile, comprising:

determining a demand component of the lateral acceleration applied to said missile; and modifying said demand component with a predetermined, time-varying gain factor in order to compensate for said missile acceleration.

7. A method accoring to claim 6, further including the step of providing guidance commands derived from said demand component to said missile.

8. A method according to claim 7, further including the step of delaying the providing of said guidance commands to said missile by a predetermined time delay.

9. A method according to claim 8, wherein said delay step includes the step of delaying said guidance commands until a ratio of missile longitudinal acceleration to missile velocity exceeds a predetermined value.

* * * * *